US010519977B2

(12) United States Patent
Zhang et al.

(10) Patent No.: US 10,519,977 B2
(45) Date of Patent: Dec. 31, 2019

(54) CENTRIFUGAL PUMP

(71) Applicant: Hangzhou Sanhua Research Institute Co., Ltd., Hangzhou, Zhejiang (CN)

(72) Inventors: Junchao Zhang, Zhejiang (CN); Wei Ye, Zhejiang (CN); Junfeng Bao, Zhejiang (CN); Rongrong Zhang, Zhejiang (CN)

(73) Assignee: Zhejiang Sanhua Automotive Components Co., Ltd., Hangzhou, Zhejiang (CN)

( * ) Notice: Subject to any disclaimer, the term of this patent is extended or adjusted under 35 U.S.C. 154(b) by 832 days.

(21) Appl. No.: 15/134,236

(22) Filed: Apr. 20, 2016

(65) Prior Publication Data

US 2016/0341218 A1 Nov. 24, 2016

(30) Foreign Application Priority Data

May 20, 2015 (CN) ..... 2015 1 0259494

(51) Int. Cl.
*F04D 29/62* (2006.01)
*F04D 29/20* (2006.01)
(Continued)

(52) U.S. Cl.
CPC ..... *F04D 29/628* (2013.01); *F01P 5/02* (2013.01); *F01P 5/10* (2013.01); *F04D 13/0606* (2013.01);
(Continued)

(58) Field of Classification Search
CPC ..... F04D 29/628; F04D 29/02; F04D 29/043; F04D 29/053; F04D 29/22;
(Continued)

(56) References Cited

U.S. PATENT DOCUMENTS 5,319,851 A * 6/1994 Ikezawa ..... B60S 1/0408 15/250.31
6,764,278 B2 * 7/2004 Ozawa ..... F04D 29/026 415/124.2
(Continued)

FOREIGN PATENT DOCUMENTS

CN 2312354 Y 3/1999
CN 201742232 U 2/2011
(Continued)

OTHER PUBLICATIONS

Extended European Search Report, dated Sep. 9, 2016, from related European Patent Application No. 16167227.4.
(Continued)

*Primary Examiner* — Justin D Seabe
*Assistant Examiner* — Joshua R Beebe
(74) *Attorney, Agent, or Firm* — Wolf, Greenfield & Sacks, P.C.

(57) ABSTRACT

A centrifugal pump is provided, which includes a rotor assembly and a shaft. The rotor assembly includes an injection molded body and a shaft sleeve, the rotor assembly is injection molded taking the shaft sleeve as an injection molding insert, and the impeller injection molded body and the shaft sleeve are fixed by injection molding. The rotor assembly is rotatably supported on the shaft by the shaft sleeve, and the shaft sleeve is processed by injection molding or forging. The shaft sleeve is of a hollow structure, and the shaft sleeve includes a body. A central hole is formed in the body. The shaft sleeve further includes an impeller limiting portion configured to limit a rotating movement and an axial movement of the shaft sleeve with respect to the injection molded body.

16 Claims, 4 Drawing Sheets

(51) Int. Cl.

| | |
|---|---|
| ***F04D 13/06*** | (2006.01) |
| ***F04D 29/22*** | (2006.01) |
| ***F01P 5/02*** | (2006.01) |
| ***F01P 5/10*** | (2006.01) |
| ***F04D 29/02*** | (2006.01) |
| ***F04D 29/043*** | (2006.01) |
| ***F04D 29/053*** | (2006.01) |
| ***F04D 29/28*** | (2006.01) |

(52) U.S. Cl.
CPC ..... *F04D 29/02* (2013.01); *F04D 29/043* (2013.01); *F04D 29/053* (2013.01); *F04D 29/22* (2013.01); *F04D 29/2222* (2013.01); *F04D 29/28* (2013.01); *F04D 29/624* (2013.01)

(58) Field of Classification Search
CPC .... F04D 29/2222; F04D 29/28; F04D 29/624; F04D 29/05; F04D 29/04; F04D 29/0405; F04D 29/046; F04D 29/60; F04D 29/605; F04D 13/0606; F01P 5/02; F01P 5/10
See application file for complete search history.

(56) References Cited

U.S. PATENT DOCUMENTS

| | | | | |
|---|---|---|---|---|
| 7,687,951 | B2 * | 3/2010 | Komori | B29C 45/1418 310/90 |
| 2002/0176773 | A1 * | 11/2002 | Ozawa | F04D 29/026 415/124.2 |
| 2007/0196035 | A1 * | 8/2007 | Shibahara | F16C 17/107 384/107 |
| 2007/0252461 | A1 * | 11/2007 | Komori | B29C 45/1418 310/90 |
| 2008/0219839 | A1 | 9/2008 | Pfetzer et al. | |
| 2008/0219893 | A1 | 9/2008 | Pfetzer et al. | |
| 2011/0033320 | A1 * | 2/2011 | Heier | F04D 13/0606 417/410.1 |
| 2012/0009357 | A1 | 1/2012 | Ochiai et al. | |
| 2013/0039784 | A1 * | 2/2013 | Teubel | F04D 29/026 417/355 |
| 2014/0294626 | A1 * | 10/2014 | Aso | F04D 13/0606 417/410.1 |
| 2015/0121948 | A1 | 5/2015 | Urabe et al. | |

FOREIGN PATENT DOCUMENTS

| | | | | |
|---|---|---|---|---|
| CN | 103256257 | A | 8/2013 | |
| DE | 102005039557 | A1 | 3/2007 | |
| EP | 2863061 | A1 | 4/2015 | |
| EP | 2273123 | B1 * | 10/2016 | F04D 29/047 |
| GB | 909510 | A | 10/1962 | |
| JP | 3357542 | B2 | 12/2002 | |
| JP | 2010-168660 | A | 8/2010 | |
| JP | 5280095 | B2 | 9/2013 | |
| KR | 10-1296393 | B1 | 8/2013 | |

OTHER PUBLICATIONS

Korean Office Action for Application No. KR 10-2016-0061515 dated Mar. 15, 2017.
First Office Action for Chinese Application No. 201510259494.X, dated Jan. 31, 2019.

* cited by examiner

CENTRIFUGAL PUMP

CROSS REFERENCE OF RELATED APPLICATION

The present application claims the priority to Chinese Patent Application No. 201510259494.X, titled "CENTRIFUGAL PUMP", filed on May 20, 2015, with the State Intellectual Property Office of the People's Republic of China, the content of which is incorporated herein by reference in its entirety.

FIELD

This application relates to the technical field of automobiles, and particularly to a component and part of an automobile heat management system.

BACKGROUND

In recent decades, automobile industry develops rapidly. With performances of automobiles developing towards a safer, more reliable, more stable, fully-automatic and intelligent, and environmental friendly and energy saving trend, electrically driven centrifugal pumps have gradually replaced the conventional mechanical centrifugal pumps, and are widely applied in automobile heat management or circulation systems. The electrically driven centrifugal pumps have advantages of having lower electromagnetic interference, high efficiency and environmental protection, stepless speed regulation, etc. thus can well meet requirements of market.

The electrically driven centrifugal pump includes a stator assembly and a rotor assembly, the stator assembly and the rotor assembly are fully isolated by a partition, which avoids the issue of liquid leakage existing in the conventional motor type centrifugal pump. Currently, the rotor assembly of the electrically driven centrifugal pump includes an impeller and a rotor, and in a conventional design, the rotor assembly is an integrally formed part, i.e., the impeller and the rotor are formed by injection molding. The rotor assembly is formed by injection molding using a mixed material of a plastic material and a magnetic material or plastic material, and taking a shaft sleeve as a base member for the injection molding, thus the shaft sleeve is generally formed in advance. The shaft sleeve is generally arranged to be rotatable with respect to the shaft, and also is covered by the material of the impeller, therefore, the structure of the shaft sleeve influences the intendity of the connection of the shaft sleeve to the impeller.

SUMMARY

An object of the present application is to provide a centrifugal pump, which includes a rotor assembly and a shaft, the rotor assembly includes an injection molded body and a shaft sleeve, the rotor assembly is injection molded taking the shaft sleeve as an injection molding insert, the impeller-injection molded body is fixed by injection molding to the shaft sleeve, and the rotor assembly is rotatably supported on the shaft via the shaft sleeve, and the shaft sleeve is formed by injection molding, or formed by forging, or formed by forging and machining, or formed by extruding and machining, or formed by powder sintering, or formed by machining. The shaft sleeve includes a body, a central hole is formed in the body of the shaft sleeve, and the body of the shaft sleeve includes an outer surface and an inner surface, and the inner surface encloses to form the central hole, and the shaft is arranged to pass through the central hole. The outer surface is fixed by injection molding to the injection molded body; the shaft sleeve further includes an impeller limiting portion, the impeller limiting portion is arranged on the outer surface, and the impeller limiting portion includes a part or all of a portion of the shaft sleeve where the shaft sleeve fits the injection molded body including the impeller, the impeller limiting portion is configured to limit a rotating movement and an axial movement of the shaft sleeve with respect to the injection molded body including the impeller.

The centrifugal pump according to the present application includes the shaft sleeve, and the shaft sleeve includes the impeller limiting portion, which may limit the upward and downward movements and rotation of the injection molded body including the impeller with respect to the shaft sleeve, and improving a connection strength between the injection molded body and the shaft sleeve.

DETAILED DESCRIPTION

The present application is further described in conjunction with the drawings and embodiments.

Centrifugal pumps include mechanical pump and electrically driven pump, and rotor assemblies of the mechanical pump and electrically driven pump may each include a shaft sleeve structure and an impeller structure, the shaft sleeve structures of the both may be the same, and the present application is described taking the electrically driven pump as an example.

Figure 1:
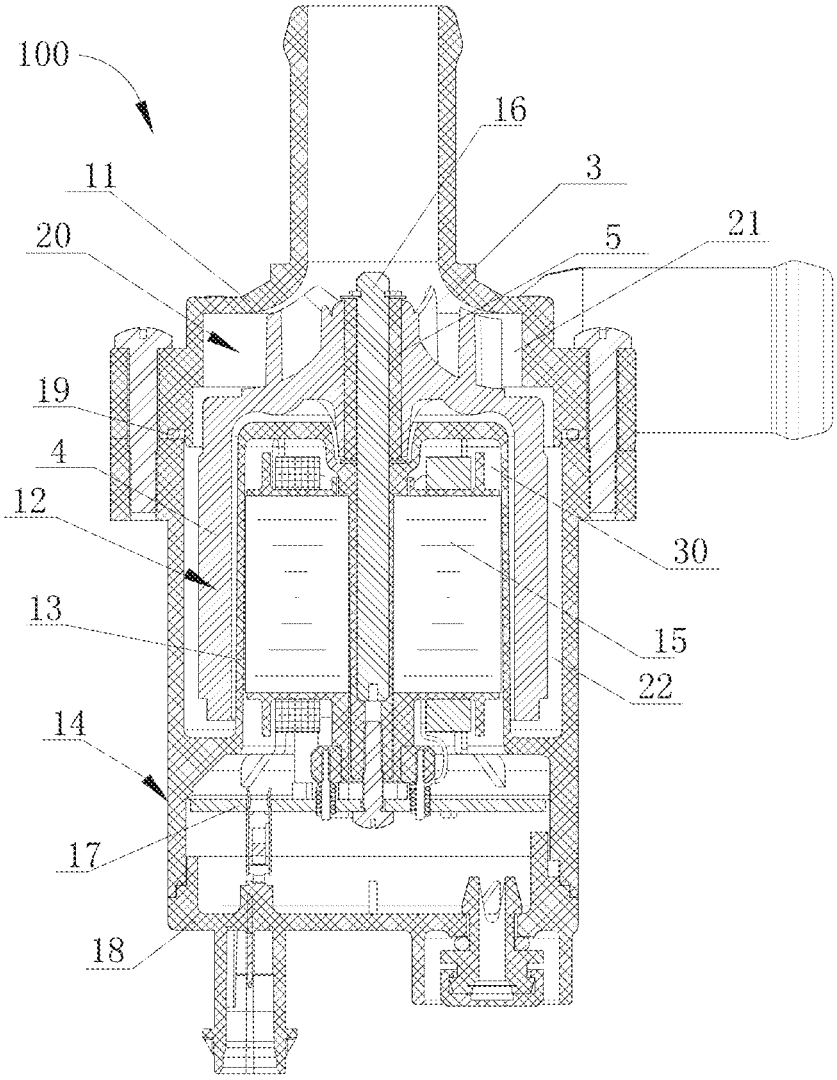
FIG. 1 is a sectional schematic view showing the structure of an electrically driven pump according to an embodiment of the present application.

FIG. 1 is a schematic view showing the structure of an electrically driven pump 100. The electrically driven pump 100 includes a first housing 11, a second housing 14, a rotor assembly 12, a stator assembly 15, a shaft 16, a printed circuit board 17, and an end cover 18. A pump inner cavity includes a space between the first housing 11 and the second housing 14, and between the second housing 14 and the end cover 18. The first housing 11 and the second housing 14 are fixedly connected, and a portion where the first housing 11 and the second housing 12 are connected is provided with an annular sealing ring 19. The electrically driven pump 100 is provided with a partition 13, and the pump inner cavity is separated by the partition 13 into a wet chamber 20 and a dry chamber 30. The wet chamber 20 may allow a working medium to pass through, and the rotor assembly 12 is arranged in the wet chamber 20. There is no working medium flowing through the dry chamber 30, and the stator assembly 15 and the printed circuit board 17 are arranged in the dry chamber 30. The stator assembly 15 is electrically connected to the printed circuit board 17 via leads, the printed circuit board 17 is connected to an external circuit via a plug. In this embodiment, the partition 13 and the second housing 14 are formed integrally by injection molding, and the second housing 14 and the partition 13 is formed by taking the shaft 16 as an injection molding insert. In this embodiment, the electrically driven pump 100 is an outer rotor type electrically driven pump, and the outer rotor type electrically driven pump is referred to as a pump in which the shaft 16 is taken as a central shaft, and a rotor 4 of the rotor assembly 12 is located at an outer periphery of the stator assembly 15, i.e., the stator assembly 15 is arranged more close to the shaft 16 than the rotor 4.

Referring to FIG. 1, the rotor assembly 12 is arranged in the wet chamber 20. The rotor assembly 12 includes an impeller 3, a rotor 4, and a shaft sleeve 5. At least the rotor 4 includes a magnetic material, and the rotor 4 is substantially of a cylindrical shape. The impeller 3 is arranged at an upper end of the rotor 4, and is fixed to the rotor 4. The impeller 3 may include or not include the magnetic material. The wet chamber 20 includes an impeller cavity 21 and a rotor cavity 22, and the impeller cavity 21 is arranged to be in communication with the rotor cavity 22, i.e., is not isolated from the rotor cavity 22. The impeller 3 is arranged in the impeller cavity 21, the rotor 4 is arranged in the rotor cavity 22, and the rotor assembly 12 is sleeved on an outer surface of the shaft 16 by the shaft sleeve 5. An injection molded body including the impeller is formed by injection molding taking the shaft sleeve 5 as an insert, an impeller limiting portion is formed on an outer surface of the shaft sleeve 5, and the impeller limiting portion is configured to limit relative axial and rotating movements between the shaft sleeve and the injection molded body.

Different forming processes for the shaft sleeve 5 are chosen according to different materials or different structures of the shaft sleeve 5. For example, in the case that the shaft sleeve 5 adopts polyphenylenesulfide (PPS) and a fibrous material, the shaft sleeve 5 can be formed by injection molding. In the case that the shaft sleeve 5 adopts a ceramic material, the shaft sleeve 5 can be formed by powder sintering. In the case that the shaft sleeve 5 adopts a metal material, the shaft sleeve 5 can be formed by forging, or can be formed by forging and then by machining. And in the case that the shaft sleeve 5 adopts a polyester fiber, the shaft sleeve 5 can be formed by machining.

Figure 2:
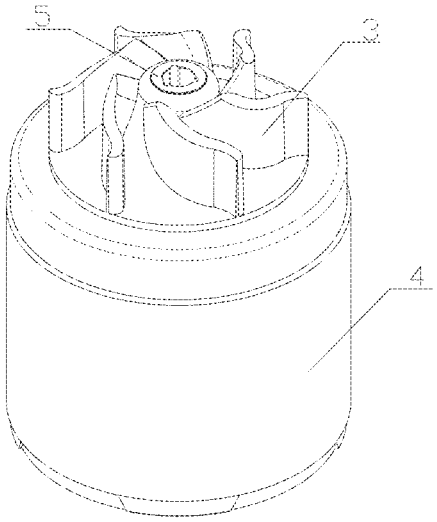
FIG. 2 is a perspective schematic view showing the structure of a rotor assembly 12 of the electrically driven pump in FIG. 1.

FIG. 2 is a schematic view showing the structure of the rotor assembly 12, the rotor assembly 12 includes an impeller 3, a rotor 4 and a shaft sleeve 5. The impeller 3 and the rotor 4 in this embodiment are integrally arranged, and the rotor assembly 12 includes an injection molded body including the impeller 3 which is formed by injection molding adopting the mixture of a magnetic material and a plastic material and taking the shaft sleeve 5 as the injection molding insert. The rotor assembly 12 is formed as an integral by injection molding, thus has a compact structure, and a good product consistency. Of course, the impeller 3 and the rotor 4 may be separately formed, and may be fixedly connected by a fixing device, and in this case, the impeller 3 and the rotor 4 may respectively adopt different materials, the impeller 3 may adopt a common plastic material, and the injection molded body including the impeller 3 may be formed taking the shaft sleeve 5 as the injection molding insert, which may reduce the cost of materials. Also, in the case that the impeller 3 adopts the plastic material, rather than the magnetic material, the toughness of the impeller 3 may be improved, a blade of the impeller 3 can be made thin, and a hydraulic performance of the electrically driven pump may be improved. In addition, the same rotors 4 may be matched with different impellers 3, and different impellers 3 may change the hydraulic performance of the electrically driven pump 100, thus the expense of molds for the rotors may be reduced. Furthermore, the cylindricity and the wall thickness evenness of the rotor 4 separately formed by injection molding are also easily ensured.

Figure 3:
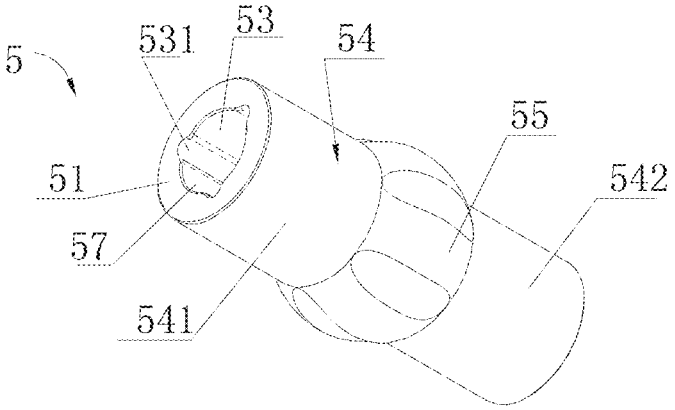
FIG. 3 is a perspective schematic view showing the structure of a first embodiment of a shaft sleeve 5 of the rotor assembly in FIG. 2.
Figure 4:
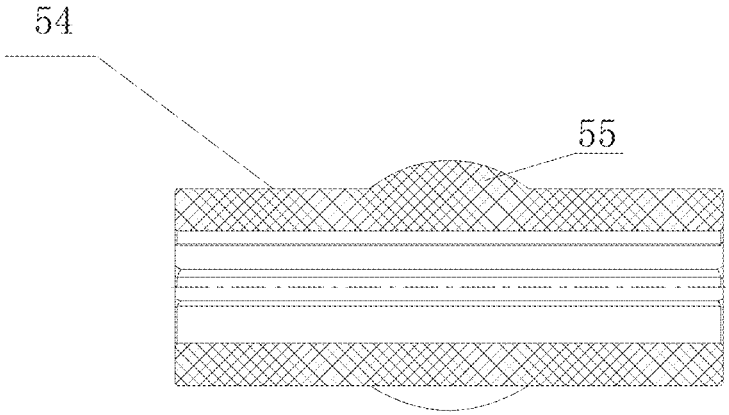
FIG. 4 is a sectional schematic view showing the structure of the shaft sleeve 5 in FIG. 3.
Figure 5:
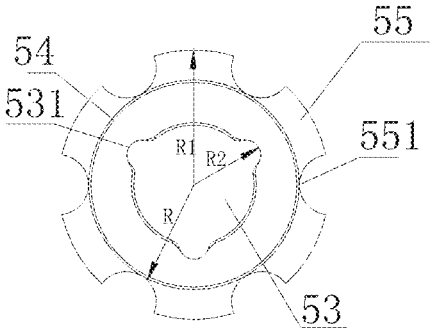
FIG. 5 is a schematic view showing the structure of the shaft sleeve 5 in FIG. 3 in an end face direction.

FIGS. 3 to 5 are schematic views showing the structure of a first embodiment of the shaft sleeve 5 of the rotor assembly 12 in FIG. 2. FIG. 3 is a perspective schematic view showing the structure of the first embodiment of the shaft sleeve 5. In this embodiment, the shaft sleeve 5 is formed integrally by injection molding, and the injection molding material includes PPS and a fibrous material. Of course, the shaft sleeve 5 may adopt other materials and be formed by other processes, however, the structures are the same as the structure in this embodiment. The shaft sleeve 5 is of a hollow structure, which includes a body 51. A central hole 53 is formed in the body 51 of the shaft sleeve 5, the body 51 of the shaft sleeve 5 includes an outer surface 54 and an inner surface 57, and the inner surface 57 encloses to form the central hole 53. The shaft sleeve 5 is arranged to cooperate with an outer surface of the shaft 16 via the central hole 53, and the shaft sleeve 5 is fixed by injection molding to the injection molded body including the impeller 3 via the outer surface 54. The shaft sleeve 5 includes an impeller limiting portion and an inner groove 531. The impeller limiting portion includes a structure which may limit a rotating movement and an axial movement of the shaft sleeve 5 with respect to the injection molded body including the impeller 3. The inner grooves 531 are sunken inwards the body 51 and are distributed at regular intervals or uniformly distributed or symmetrically distributed in the circumferential direction of the inner surface. And an inner passage includes a certain clearance formed between the shaft 16 and the inner groove 531 of the shaft sleeve 5. When the electrically driven pump 100 works, the working medium may enter into the clearance between the shaft 16 and the shaft sleeve 5, thus may have a lubricating function, and also may cool contact surfaces of the shaft 16 and the shaft sleeve 5. The impeller limiting portion is at least one part of a portion where the shaft sleeve 5 fits the injection molded body including the impellor 3. The impeller limiting portion may be a protrusion or a groove portion formed on the outer surface of the shaft sleeve 5. The groove portion is defined only relative to the outer surface, and if the groove portion is taken as the outer surface, it also corresponds to a protrusion. The embodiment in which the impeller limiting portion is embodied as the protrusion is described as follows.

In this embodiment, the outer surface 54 includes a first reference surface, and the impeller limiting portion includes protrusions 55 arranged at intervals and protruding beyond the first reference surface of the outer surface 54 in a radial direction of the shaft sleeve 5. The protrusions 55 extend in an axial direction of the shaft sleeve 5. In this embodiment, the protrusions 55 are arranged at substantially same intervals or uniformly distributed in the circumferential direction of the outer surface 54, thus the shaft sleeve of injection molded, the shrinkage is relatively uniform, and the consistency of the shaft sleeve is relatively good. However, the shaft sleeves formed by other forming processes, the protrusions 55 extend in the axial direction of the shaft sleeve, and the protrusions 55 may be not uniformly distributed along the circumference direction of the shaft sleeve 5.

Reference is made to FIGS. 3 and 4, the outer surface 54 includes a first cylindrical surface 541, a second cylindrical surface 542, and protrusions 55. The first cylindrical surface 541 and the second cylindrical surface 542 are the first reference surface of the shaft sleeve 5 in this embodiment, and outer diameters of the first cylindrical surface 541 and the second cylindrical surface 542 are substantially the same. In the axial direction of the shaft sleeve 5, a length of the first cylindrical surface 541 is substantially the same as a length of the second cylindrical surface 542. The protrusions 55 are arranged between the first cylindrical surface 541 and the second cylindrical surface 542, and a maximum diameter of the protrusion 55 is greater than the outer diameter of the first cylindrical surface 541. A minimum diameter of the protrusion 55 is at least equal to the outer diameter of the first cylindrical surface 541. In a cross section passing through a central axis of the shaft sleeve 5 and an outer surface of the protrusion 55, the protrusion 55 is substantially of a circular-arc shape or a combination of the circular-arc shapes or includes at least a circular-arc shaped part. Since a length of the protrusion 55 is less than a length of the shaft sleeve 5, the protrusions 55 may limit the axial movement of the shaft sleeve 5 with respect to the injection molded body including the impeller 3. With the structure in this embodiment, the injection molded part including the impeller formed by injection molding can be easily released from the mold. A groove is formed between adjacent protrusions, thus the protrusions 55 may limit the rotation of the shaft sleeve 5 with respect to the injection molded body including the impeller. Of course, in the case that one part of the protrusion 55 has a height greater than another part of the protrusion 55, and the length of the protrusion is the same as the length of the shaft sleeve 5, the axial movement of the shaft sleeve with respect to the injection molded body including the impeller may also be limited.

An inner groove 531 is formed in the inner surface 57 of the shaft sleeve 5, and the inner grooves 531 are sunken inwards the body 51 of the shaft sleeve 5 and are distributed at regular intervals or uniformly distributed or symmetrically distributed in the circumferential direction of the inner surface. And the inner groove 531 is arranged to be in communication with the central hole 53. A depth of the inner groove 531 is less than one half of a thickness, of the thinnest portion of the body 51 of the shaft sleeve 5; and a width of the inner groove 531 is less than or equal to two times of the depth of the inner groove 531. The inner passage of the electrically driven pump 100 includes a certain clearance formed between the shaft 16 and the inner groove 531 of the shaft sleeve 5. When the electrically driven pump 100 works, the working medium may enter into the clearance between the shaft 16 and the shaft sleeve 5, thus may have a lubricating function, may also cool the contact surfaces of the shaft 16 and the shaft sleeve 5, and may ensure a service life of the shaft sleeve 5.

FIG. 5 is a schematic view showing the structure of the shaft sleeve 5 in FIG. 3 in an end surface direction, the first cylindrical surface 541 has an outer diameter R, the protrusion 55 has a maximum outer diameter R1, and the inner groove 531 has a maximum outer diameter R2. As can be seen from the drawing, a depth of the groove 551 between adjacent protrusions 55 is the same as a height of the protrusion 55 protruding beyond the first cylindrical surface 541 (a difference value between R and R1), and the depth of the inner groove 531 is slightly less than the protruding height of the protrusion 55. The inner grooves 531 and the grooves 551 are arranged at intervals, i.e., the inner groove 531 is arranged at the portion where the protrusion 55 is arranged, thus allowing thicknesses of the portions of the shaft sleeve 5 to be as uniform as possible, and facilitating reducing the unevenness of shrinkage caused during injection molding of the shaft sleeve 5. Also the number of the inner grooves 531 is less than the number of the protrusions 55, which may improve a strength and a forming precision of the shaft sleeve 5.

Figure 6:
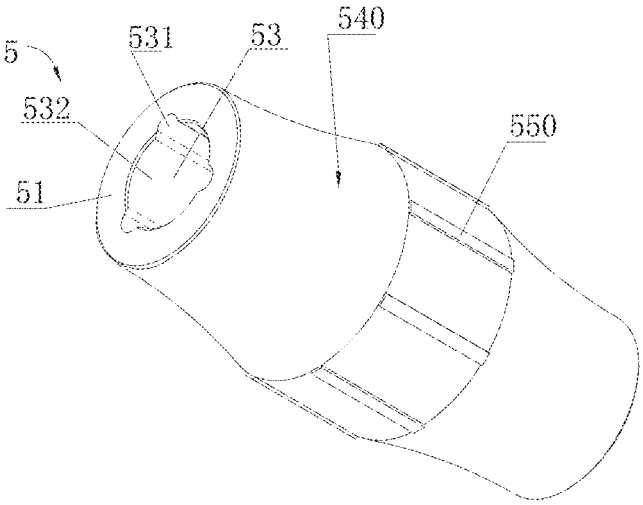
FIG. 6 is a perspective schematic view showing the structure of a second embodiment of the shaft sleeve 5 of the rotor assembly in FIG. 2.

FIG. 6 is a schematic view showing the structure of a second embodiment of the shaft sleeve 5 of the rotor assembly 12 in FIG. 2. The shaft sleeve 5 is formed integrally by injection molding, the material for the injection molding includes PPS and a fibrous material. Of course, the shaft sleeve 5 may also adopt other materials, and the structure thereof is the same as the structure in this embodiment. The shaft sleeve 5 is of a hollow structure, which includes a body 51, and a central hole 53 is formed in the body 51 of the shaft sleeve 5. The body 51 of the shaft sleeve 5 includes an inner surface 532 and an outer surface 540, and the inner surface 532 encloses to form the central hole 53. The shaft sleeve 5 is arranged to cooperate with an outer surface of the shaft 16 via the central hole 53, and the shaft sleeve 5 is fixed by injection molding to the injection molded body including the impeller 3 via the outer surface 540. The shaft sleeve 5 includes an impeller limiting portion and an inner groove 531. The impeller limiting portion is arranged on the outer surface 540 of the shaft sleeve 5, and the inner groove 531 is arranged in the inner surface 532 of the shaft sleeve 5. The impeller limiting portion may be of a structure which may limit a rotating movement and an axial movement of the shaft sleeve 5 with respect to the injection molded body including the impeller 3. The inner grooves 531 are sunken inwards the body 51 the shaft sleeve 5 and are distributed at regular intervals or uniformly distributed or symmetrically distributed in the circumferential direction of the inner surface. An inner passage includes a certain clearance formed between the shaft 16 and the inner groove of the shaft sleeve 5. When the electrically driven pump 100 operates, the working medium may enter into the clearance between the shaft 16 and the shaft sleeve 5, thus may function to lubricate, and also cool contact surfaces of the shaft 16 and the shaft sleeve 5. A main difference between the shaft sleeve of this embodiment and the shaft sleeve in the first embodiment is that, the impeller limiting portion includes protrusions 550 protruding beyond the outer surface 540, outer diameters of the protrusions 550 are substantially the same, the outer surface 540 is divided by the protrusions 550 into three parts, and the protrusions 550 are located at a middle part of the shaft sleeve 5, the protrusions 550 each have an outer diameter greater than outer diameters of other two parts. The other two parts of the outer surface 540 are both circular-arc surfaces, and the other two parts include circular-arc surfaces. And the circular-arc surfaces have outer diameters gradually increased from two ends of the shaft sleeve 5 to two ends of the protrusions 550 respectively.

Figure 7:
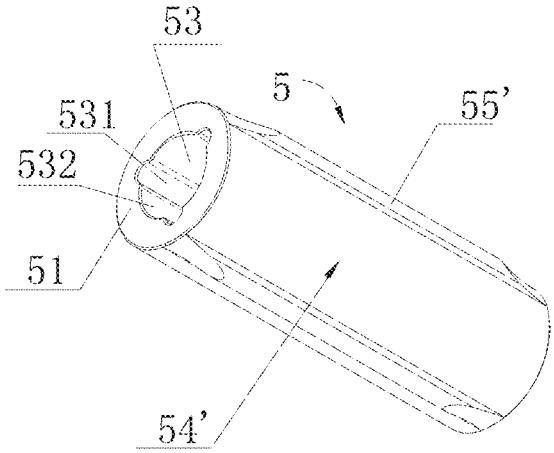
FIG. 7 is a perspective schematic view showing the structure of a third embodiment of the shaft sleeve 5 of the rotor assembly in FIG. 2.
Figure 8:
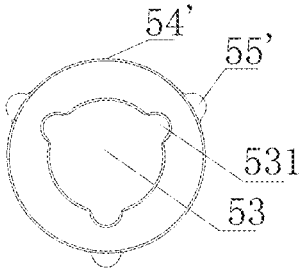
FIG. 8 is a schematic view showing the structure of the shaft sleeve 5 in FIG. 7 in an end face direction.
Figure 9:
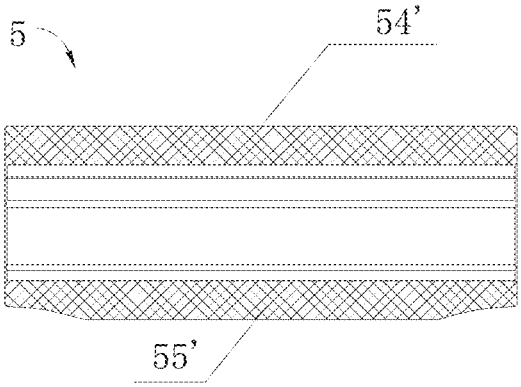
FIG. 9 is a sectional schematic view showing the structure of the shaft sleeve 5 in FIG. 7.

FIGS. 7 to 9 are schematic views showing the structure of a third embodiment of the shaft sleeve 5 of the rotor assembly 12 in FIG. 2. In this embodiment, the shaft sleeve 5 is an injection molded part, and the material for the injection molding includes PPS and a fibrous material. Of course, the shaft sleeve 5 may also adopts other materials, and the structure thereof is the same as the structure in this embodiment. The shaft sleeve 5 is of a hollow structure, which includes a body 51, and a central hole 53 is formed in the body 51 of the shaft sleeve 5. The body of the shaft sleeve 5 includes an inner surface 532 and an outer surface 54', and the inner surface 532 encloses to form the central hole 53. The shaft sleeve 5 is arranged to cooperate with the outer surface of the shaft 16 (referring to FIG. 1) via the central hole 53, and the shaft sleeve 5 is fixed by injection molding to the injection molded body including the impeller via the outer surface 54'. The shaft sleeve 5 includes an impeller limiting portion, and the impeller limiting portion includes protruding ribs 55' protruding beyond the outer surface 54' and arranged at intervals. The body 51 of the shaft sleeve 5 includes inner grooves 531, the inner grooves 531 are sunken inwards the body 51 of the shaft sleeve 5 and are distributed at regular intervals or uniformly distributed or symmetrically distributed in the circumferential direction of the inner surface 532. In this way, an inner passage includes a certain clearance formed between the shaft 16 and the shaft sleeve 5 at a portion where the inner groove 531 is arranged. Thus, in the case that the electrically driven pump 100 works, the working medium may enter into the clearance between the shaft 16 and the shaft sleeve 5, thus may have a lubricating effect, and may also cool contact surfaces of the shaft 16 and the shaft sleeve 5.

In this embodiment, the protruding ribs 55' extend in the axial direction of the shaft sleeve 5, and the lengths of the protruding ribs 55' are slightly less than the length of the shaft sleeve 5, or, the lengths of the protruding ribs 55' are the same as the length of the shaft sleeve and a cutting structure is formed close to two ends of the shaft sleeve 5. Thus, in the case that an injection molded body including the impeller 3 is formed taking the shaft sleeve 5 as an injection molding insert, a plastic coating layer may be well formed. The protruding ribs 55' protrude in radial directions of shaft sleeve, and the protruding ribs 55' are arranged at positions corresponding to positions of the inner grooves 531, also, a protruding height of each of the protruding ribs 55' is the same as a depth of each of the inner grooves 531, thus may ensure the thickness uniformity of the wall of the shaft sleeve 5, avoid the shrinkage unevenness of the shaft sleeve 5 caused during injection molding, and may improve the product yield of the injection molded member of the shaft sleeve 5. A number of the inner grooves 531 is three, and a number of the protruding ribs 55' is three, and the three protruding ribs 55' are arranged symmetrically in the circumferential direction of the shaft sleeve 5, which facilitates the dynamic balance of the shaft sleeve in rotating process. The protruding ribs 55' arranged in such a way may prevent a rotating movement and an axial movement of the injection molded body including the impeller 3 with respect to the shaft sleeve 5.

It should be noted that, the above embodiments are only intended to describe the present application, and should not be interpreted as a limitation to the technical solutions of the present application. Although the present application is described in detail in conjunction with the above embodiments, it should be understood by those skilled in the art that, modifications or equivalent substitutions may still be made to the present application by those skilled in the art; and any technical solutions and improvements thereof without departing from the spirit and scope of the present application also fall into the scope of the present application defined by the claims.

The invention claimed is:

1. A centrifugal pump, comprising a rotor assembly and a shaft, wherein the rotor assembly comprises an injection molded body and a shaft sleeve, the injection molded body comprises an impeller, the rotor assembly is formed by injection molding taking the shaft sleeve as an injection molding insert, the injection molded body is fixed to the shaft sleeve by injection molding, and the rotor assembly is rotatably supported on the shaft via the shaft sleeve, wherein:

the shaft sleeve is formed by injection molding, or formed by forging, or formed by forging and machining, or formed by extruding and machining, or formed by powder sintering, or formed by machining;

the shaft sleeve comprises a body, a central hole is formed in the body of the shaft sleeve, the body of the shaft sleeve comprises an outer surface and an inner surface, the inner surface encloses to form the central hole, the shaft is arranged to pass through the central hole, and the outer surface is fixed by injection molding to the injection molded body; and the shaft sleeve further comprises an impeller limiting portion, the impeller limiting portion is arranged on an outer surface of the shaft sleeve, the impeller limiting portion comprises protrusions distributed at intervals and protruding beyond the outer surface of the shaft sleeve in a radial direction, and the impeller limiting portion is configured to limit a rotating movement and an axial movement of the shaft sleeve with respect to the injection molded body via the protrusions; and inner grooves are formed in an inner surface of the shaft sleeve and are formed by sinking from the inner surface of the shaft sleeve into a body of the shaft sleeve, the inner grooves are arranged at portions where the protrusions are arranged; and wherein the protrusions are protruding ribs formed by protruding from the outer surface of the shaft sleeve, and the protruding ribs extend in an axial direction of the shaft sleeve, a width of each of the protruding ribs is less than a distance between adjacent protruding ribs, the protruding ribs are arranged to form at least one segment in the axial direction of the shaft sleeve, and top portions of the protruding ribs are located in the same cylindrical surface or the same truncated conical surface taking a central axis of the shaft sleeve as a central line;

the centrifugal pump comprises at least one inner passage, and the inner passage comprises clearances formed between the shaft and the inner grooves of the shaft sleeve; and the number of protruding ribs is the same as the number of the inner grooves, the protruding ribs are arranged corresponding to the inner grooves, and thicknesses of positions where the inner grooves and the protruding ribs are arranged, of the body of the shaft sleeve are equal to thicknesses of positions where the inner grooves and the protruding ribs are not provided, of the body of the shaft sleeve.

2. The centrifugal pump according to claim 1, wherein protrusions extend in an axial direction of the shaft sleeve, and lengths of the protrusions are less than or equal to a length of the shaft sleeve, or a height of one part of each of the protrusions protruding beyond the outer surface of the shaft sleeve is greater than a height of another part of the protrusion.

3. The centrifugal pump according to claim 2, wherein the outer surface of the shaft sleeve comprises a first cylindrical surface and a second cylindrical surface, an outer diameter of the first cylindrical surface is the same as an outer diameter of the second cylindrical surface, each of the protrusions is arranged between the first cylindrical surface and the second cylindrical surface, and in a cross section passing through a central axis of the shaft sleeve and the protrusion, each of the protrusions comprises at least a circular-arc shaped part.

4. The centrifugal pump according to claim 3, wherein at least two said impeller limiting portions are provided in a circumferential direction of the outer surface of the shaft sleeve, and the impeller limiting portions are distributed at equal intervals or uniformly distributed in the circumferential direction of the outer surface of the shaft sleeve.

5. The centrifugal pump according to claim 4, wherein the centrifugal pump comprises at least one inner passage, and the inner passage comprises clearances formed between the shaft and the inner grooves of the shaft sleeve.

6. The centrifugal pump according to claim 2, wherein the outer diameters of the protrusions are the same, the outer surface of the shaft sleeve comprises three parts, the protrusions are located at a middle part of the shaft sleeve, each of the protrusions has a maximum outer surface, the maximum outer surface forming a virtual circle, the virtual circle has a diameter greater than outer diameters of the other two parts of the outer surface, and along the axial direction of the shaft sleeve, the other two parts of the outer surface have outer diameters gradually increased from two ends of the shaft sleeve to a connection portion between the protrusions and the other two parts.

7. The centrifugal pump according to claim 6, wherein at least two said impeller limiting portions are provided in a circumferential direction of the outer surface of the shaft sleeve, and the impeller limiting portions are distributed at equal intervals or uniformly distributed in the circumferential direction of the outer surface of the shaft sleeve.

8. The centrifugal pump according to claim 7, wherein the centrifugal pump comprises at least one inner passage, and the inner passage comprises clearances formed between the shaft and the inner grooves of the shaft sleeve.

9. The centrifugal pump according to claim 2, wherein at least two said impeller limiting portions are provided in a circumferential direction of the outer surface of the shaft sleeve, and the impeller limiting portions are distributed at equal intervals or uniformly distributed in the circumferential direction of the outer surface of the shaft sleeve.

10. The centrifugal pump according to claim 9, wherein the centrifugal pump comprises at least one inner passage, and the inner passage comprises clearances formed between the shaft and the inner grooves of the shaft sleeve.

11. The centrifugal pump according to claim 2, wherein the centrifugal pump comprises at least one inner passage, and the inner passage comprises clearances formed between the shaft and the inner grooves of the shaft sleeve.

12. The centrifugal pump according to claim 1, wherein a length of each of the protruding ribs is the same as a length of the shaft sleeve, each of the protruding ribs comprises portions towards two ends of the shaft sleeve and a portion at a middle portion of the shaft sleeve, and a height of each of the portions towards two ends of the shaft sleeve protruding beyond the outer surface of the shaft sleeve is less than a height of the portion at the middle portion of the shaft sleeve protruding beyond the outer surface of the shaft sleeve.

13. The centrifugal pump according to claim 12, wherein at least two said impeller limiting portions are provided in a circumferential direction of the outer surface of the shaft sleeve, and the impeller limiting portions are distributed at equal intervals or uniformly distributed in the circumferential direction of the outer surface of the shaft sleeve.

14. The centrifugal pump according to claim 13, wherein the centrifugal pump comprises at least one inner passage, and the inner passage comprises clearances formed between the shaft and the inner grooves of the shaft sleeve.

15. The centrifugal pump according to claim 1, wherein at least two said impeller limiting portions are provided in a circumferential direction of the outer surface of the shaft sleeve, and the impeller limiting portions are distributed at equal intervals or uniformly distributed in the circumferential direction of the outer surface of the shaft sleeve.

16. The centrifugal pump according to claim 15, wherein the centrifugal pump comprises at least one inner passage, and the inner passage comprises clearances formed between the shaft and the inner grooves of the shaft sleeve.

* * * * *